US006811283B1

(12) United States Patent
Kovacs

(10) Patent No.: US 6,811,283 B1
(45) Date of Patent: Nov. 2, 2004

(54) DECORATIVE ILLUMINATED ARTIFICIAL ICICLE ASSEMBLY

(76) Inventor: Laszlo Kovacs, 1380 San Vicente Rd., Ramona, CA (US) 92065

( * ) Notice: Subject to any disclaimer, the term of this patent is extended or adjusted under 35 U.S.C. 154(b) by 8 days.

(21) Appl. No.: 10/417,676

(22) Filed: Apr. 17, 2003

(51) Int. Cl.[7] ..... F21V 21/00

(52) U.S. Cl. ..... 362/249; 362/252; 362/391; 362/806; 362/293

(58) Field of Search ..... 362/121, 122, 362/227, 235, 249, 293, 252, 391, 296, 310, 311, 806, 147, 152, 800, 565, 566, 807, 808

(56) References Cited

U.S. PATENT DOCUMENTS 3,302,013 A * 1/1967 Richardson ..... 362/311
5,918,967 A * 7/1999 Land ..... 362/255
6,224,239 B1 * 5/2001 Adler ..... 362/252
6,394,624 B1 * 5/2002 Hsu ..... 362/249
6,494,591 B1 * 12/2002 Guimond ..... 362/249

* cited by examiner

*Primary Examiner*—Sandra O'Shea
*Assistant Examiner*—B Q Truong
(74) *Attorney, Agent, or Firm*—Charles C. Logan, II

(57) ABSTRACT

A decorative illuminated artificial icicle assembly having a lamp housing having an open bottom end. An upright oriented elongated icicle-shaped body member has its top end detachably secured to the open bottom end of the lamp housing. The outer diameter of the icicle-shaped body member at its top end is less than the width of the open bottom end of the lamp housing to provide a light ray passage open space therebetween. A light source is mounted in the lamp housing. The lamp housing has a reflective inner surface that directs light rays downwardly into the interior of the top end of the icicle-shaped body member and also through the light ray passage open space to illuminate the outer surface of the icicle-shaped body member. The icicle-shaped body member may be tubular and have an aperture in its bottom for draining moisture that condenses therein. A colored lens positioned between the light source and the icicle-shaped body member can be used to vary the color of the illumination.

19 Claims, 2 Drawing Sheets

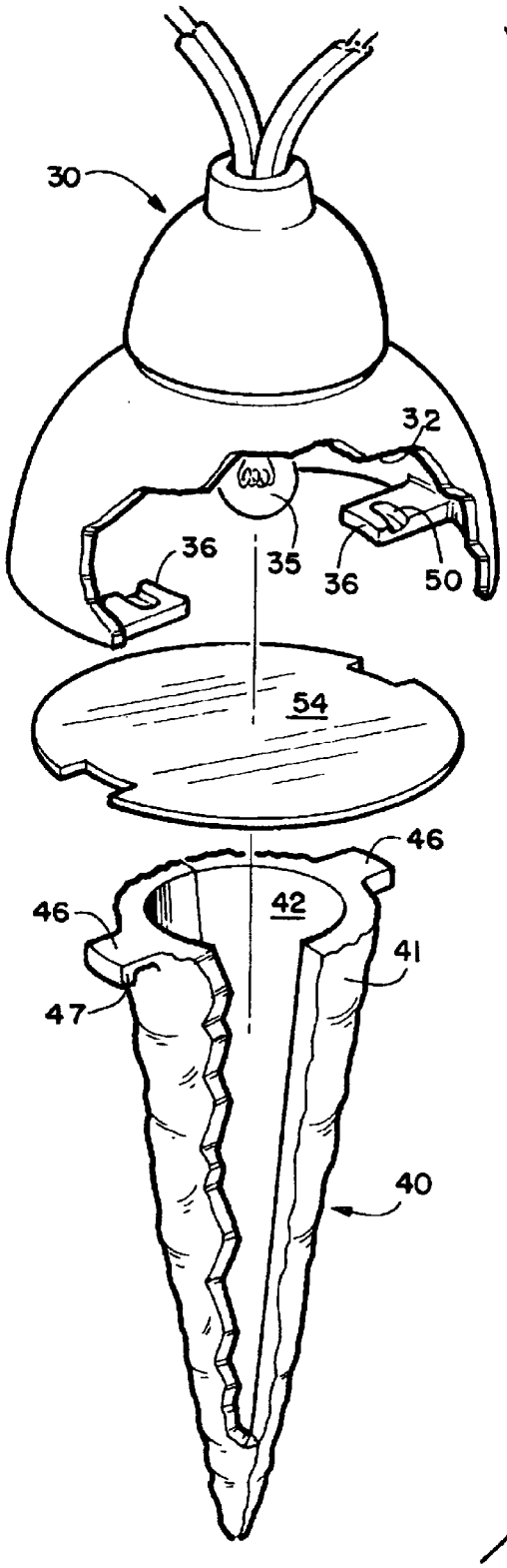
FIG.5
FIG.6
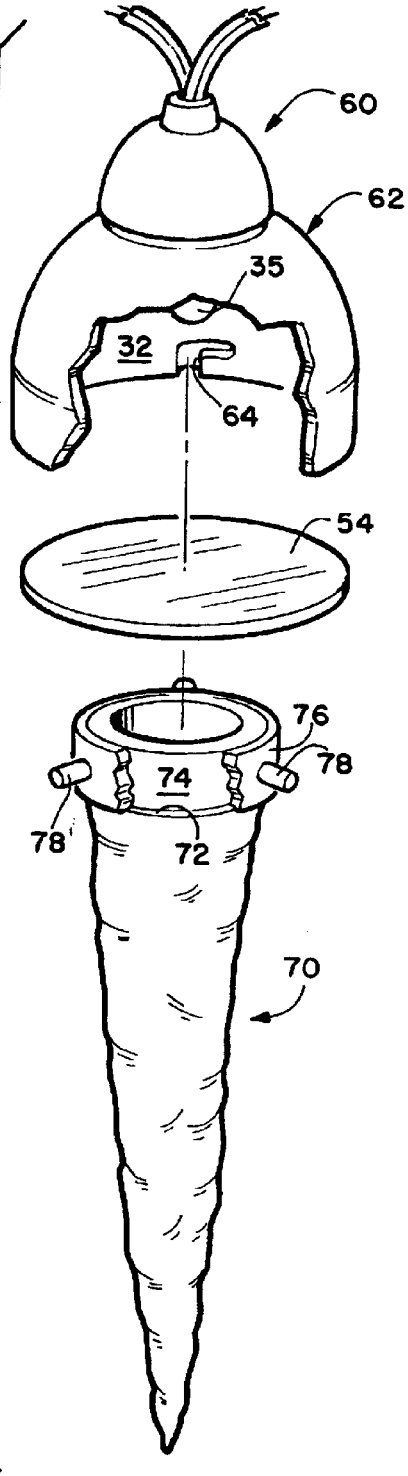

DECORATIVE ILLUMINATED ARTIFICIAL ICICLE ASSEMBLY

BACKGROUND OF THE INVENTION

The invention relates to a decorative lamp and more specifically to one having a vertically oriented icicle-shaped body member. Existing structures are presently known having decorative lamp casings that have the appearance of an icicle. These structures do not present the visual effect of real icicles such as are found hanging from the roof of a house or building in parts of the world having ice and snow during the winter season. Some of these structures will be identified and discussed below.

The Land U.S. Pat. No. 5,918,967 discloses decorative lamp casings and lamp bulb envelopes shaped like an icicle. These lamp casings have circumferentially spaced resilient fingers adjacent their top ends that are detachably secured to the lamp bulbs of a string of Christmas tree lights. The stated icicle effect of the lamp casing is enhanced by simulated frozen water runs on the outer surface of the casing. In one embodiment of the invention, the lamp casing is integrally formed with the externally threaded base of the lamp bulb. This allows it to be threaded into the existing lamp bulb sockets of a string of lights.

The Adler U.S. Pat. No. 6,224,239 is directed to a decorative lamp structure with an icicle shape having an interior with a plurality of vertically spaced lights. A plurality of these lamp fixtures would be connected to the electrical cord of a string of Christmas tree lights.

The Hsu U.S. Pat. No. 6,394,624 is directed to a decorative artificial icicle for receiving a lampset therein that includes a tubular tapered body and a long plug receivable in the top of the body. The plug includes a cap and a clip with at least one clamp formed thereon. The clip extends into the tubular tapered body when the cap is secured in the top thereof. The clamp contains a bulb in a desired location.

It is an object of the invention to provide a novel decorative artificial icicle assembly that can be illuminated both interiorly and exteriorly by the same lamp bulb.

It is also an object of the invention to provide a novel decorative artificial icicle assembly that has a detachable elongated icicle-shaped tubular body member that allows the lamp bulb to be replaced when it burns out.

It is another object of the invention to provide a novel decorative artificial icicle assembly that has removable different colored lenses that allow the icicle assembly to change its visual colored appearance.

It is a further object of the invention to provide a novel decorative artificial assembly that has different length icicle-shaped body members that range in length from 1.5–18 inches to simulate real icicles such as commonly seen hanging from the eaves of the roof of a house or a building in the wintertime.

It is an additional object of the invention to provide a novel decorative artificial icicle assembly that is economical to manufacture and market.

It is also an object of the invention to provide a conventional string of Christmas tree lights with the novel decorative artificial icicle assemblies.

SUMMARY OF THE INVENTION

The decorative illuminated artificial icicle assembly has a lamp housing, a light source and an elongated icicle-shaped body member. The lamp housing has an open bottom end having an interior width W1. The lamp housing has an interior chamber in communication with the open bottom end and the light source is mounted therein. The light source could be a single bulb or multiple bulbs or one or more LED's. The interior of the lamp housing has a reflective surface that directs some of the light rays of the light source toward the open bottom end of the lamp housing.

The elongated icicle-shaped body member has a top end having a width W2. W2 is smaller than WI by a predetermined amount so that some of the light rays from the light source can be reflected downwardly against the outer surface of the icicle-shaped body member. The icicle-shaped body member has a length L1 in the range of 1.5–18 inches. It is preferably made from a translucent plastic material that would diffuse the light rays transmitted downwardly into the interior of the icicle-shaped body member. The icicle-shaped body member is preferably tubular but could also be made as a solid member. It could be made as a single tubular member or it could be made from multiple sections which assembled form the icicle-shaped body member. The icicle-shaped body member may also have a hole or aperture in its bottom end that will allow moisture or condensation therein to flow or drip outwardly from the interior of the icicle-shaped body member.

Various structures can be used to detachably support the top end of the icicle-shaped body member from the bottom end of the lamp housing.

A colored lens may be positioned between the light source and the top end of the icicle-shaped body member to vary the illuminated color of the icicle-shaped body member. A plurality of the decorative illuminated artificial icicle assemblies are connected to an electrical cord at longitudinally spaced positions similar to that of Christmas lights. The lamp housings would be supported from the eaves of the roof of a house or building.

In another embodiment of the invention the decorative artificial icicle assemblies could be used with a conventional string of Christmas tree lights that are hung on a Christmas tree itself. In such an embodiment the icicle-shaped body member could be less than one inch in length.

DESCRIPTION OF THE DRAWINGS

FIG. 5 is an exploded front perspective view of the decorative illuminated artificial icicle assembly; and FIG. 6 is an exploded front perspective view of a first alternative embodiment of the decorative illuminated artificial icicle assembly.

DESCRIPTION OF THE PREFERRED EMBODIMENT

The decorative artificial icicle assembly will now be described by referring to FIGS. 1–6 of the drawings. The artificial icicle assembly is generally designated numeral 10. A plurality of the assemblies are secured to an electrical cord 12 having a male plug 14 on its end. The assemblies 10 would be spaced at predetermined intervals along the length of electrical cord 12.

Figure 1:
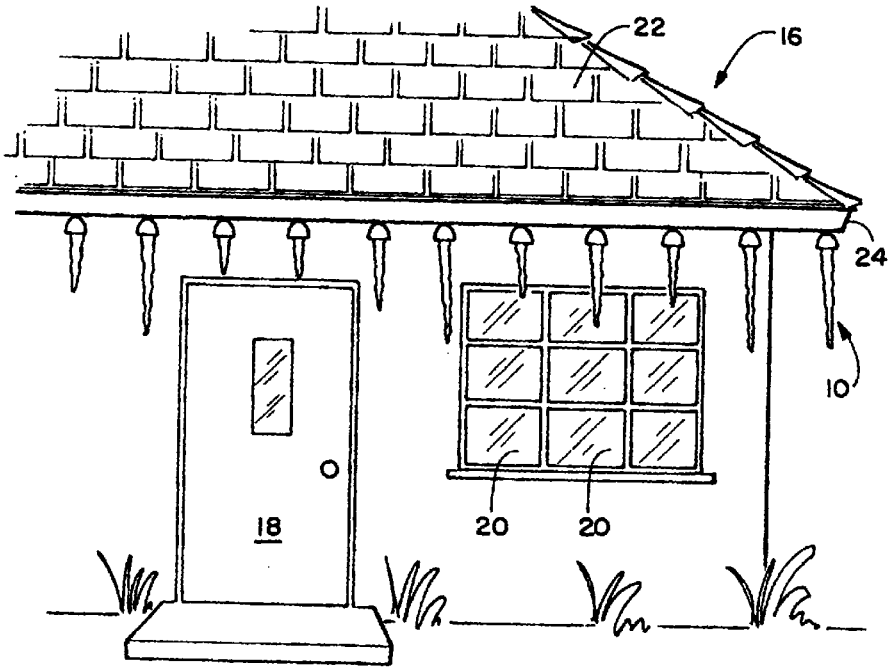
FIG. 1 is a front perspective view illustrating the novel decorative illuminated artificial icicle assemblies supported from the eaves of a roof.

FIG. 1 shows a house 16 having a front door 18, windows 20, and a roof 22. Roof 22 has an eave 24 to which the electrical cord 12 and the artificial icicle assemblies 10 would be secured and supported therefrom.

Figure 2:
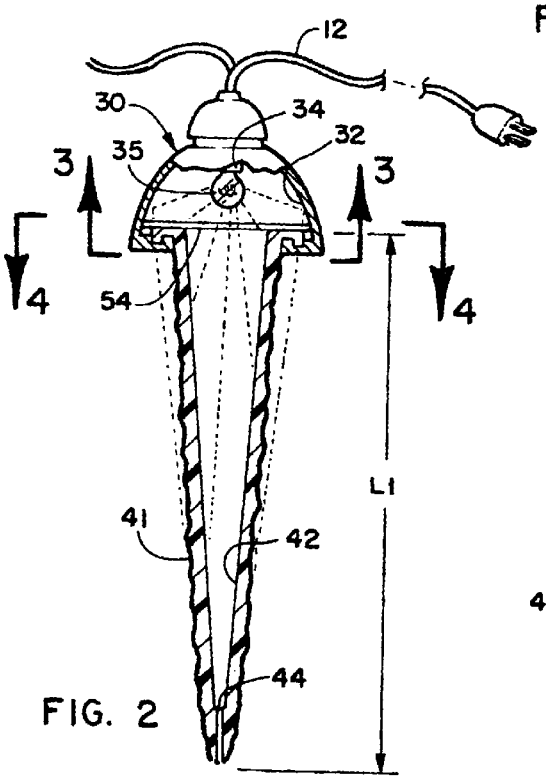
FIG. 2 is a vertical cross sectional view illustrating the decorative illuminated artificial icicle assembly.
Figure 3:
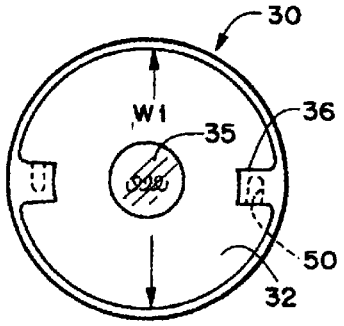
FIG. 3 is a view taken along lines 3—3 of FIG. 2.
Figure 4:
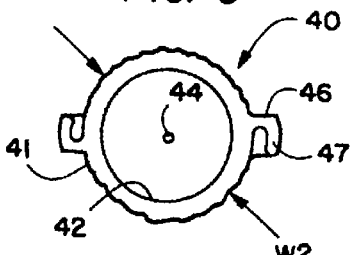
FIG. 4 is a view taken along lines 4—4 of FIG. 2.

FIGS. 2–5 show the specific structure of the individual artificial assemblies 10. They have a lamp housing 30 having a concave reflective inner surface 32 and a convex shaped outer surface. A light bulb socket 34 is positioned within lamp housing 30 and it is electrically connected to electrical cord 12. Lamp housing 30 has an open bottom end that is best illustrated in FIG. 3. It has an internal width WI. A plurality of support arms 36 extend radially inwardly from inner reflective surface 32. The top surface of support arms 36 have grooves 50 therein.

Icicle-shaped body member 40 is tubular and it has an outer surface 41 and an inner surface 42. An aperture 44 is formed in its bottom end to allow moisture and condensation that may accumulate within body member 40 to drain outwardly therefrom. Body member 40 has a length L1 that is in the range of 1.5–18 inches. Body member 40 is illustrated as being formed of two identical halves, but it could also be formed as an integral single member. It is made of a plastic material and in one of its preferred embodiments it would be made of PLEXIGLASS. The top end of body member 40 has a pair of radially extending fingers 46 having downwardly extending flanges 47 that would detachably engage grooves 50 on support arms 36. This would be accomplished by a minimal amount of angular rotation.

The top end of body member 40 has a width W2 that is less than the width W1 of the open bottom end of lamp housing 30 by a predetermined amount to form a light ray passage opening that is substantially annular. FIG. 2 shows that light rays from light bulb 35 reflect off reflective surface 32 and illuminate the outer surface of icicle-shaped body member 40. Other light rays from light bulb 35 pass directly to the inner surface 42 of icicle-shaped body member 40 and illuminate it from within. A removable colored lens or filter 54 can be used to change the color of the icicle body member.

An alternative embodiment of the decorative illuminated artificial icicle assembly is illustrated in FIG. 6 and it is designated numeral 60. It has a lamp housing 62 having an open bottom end. A bulb 35 is removably mounted in a socket therein that is electrically connected to electrical cord 12. Lamp housing 62 has an inner reflective surface 32. A plurality of bayonet-type slots 64 are formed in the inner surface at spaced intervals around its periphery. The icicle-shaped body member 70 has a shoulder 72 adjacent its top end along with a reduced diameter neck portion 74. Body member 70 is illustrated as being an integral single member but it could also be made of two or more parts. A collar 76 could be frictionally secured on neck portion 74 or glued thereto. Collar 76 has a plurality of radially extending pin members 78 that detachably engage the bayonet-type slots 64 with a minimal rotational motion. This embodiment functions in the same manner as that previously discussed with respect to icicle-shaped body member 40 and lamp housing 30.

What is claimed is:

1. A decorative illuminated artificial icicle assembly comprising:

an upright oriented lamp housing having a top end, an open bottom end, an outer surface, an inner surface, and an interior chamber in communication with said open bottom end; said open bottom end having an interior width W1;

a light source;

means for supporting said light source in said lamp housing;

an upright oriented elongated icicle-shaped body member having an outer surface, a top end, a bottom end and said top end having a width W2;

means for securing said top end of said icicle-shaped body member to said open bottom end of said lamp housing; and said width W2 of said top end of said icicle-shaped body member being less than said width W1 of said bottom end of said lamp housing by a predetermined amount to provide a light ray passage open space that will allow light rays from said light source to pass downwardly therethrough said light ray passage open space and illuminate said outer surface of said icicle-shaped body member.

2. A decorative illuminated artificial icicle assembly as recited in claim 1 wherein said icicle-shaped body member has a length L1 and L1 is in the range of 1.5–18 inches.

3. A decorative illuminated artificial icicle assembly as recited in claim 1 wherein said light source is at least one light bulb.

4. A decorative illuminated artificial icicle assembly as recited in claim 1 wherein said outer surface of said lamp housing is substantially dome-shaped.

5. A decorative illuminated artificial icicle assembly as recited in claim 1 wherein said inner surface of said lamp housing has reflector means for directing light rays downwardly through said light ray passage open space.

6. A decorative illuminated artificial icicle assembly as recited in claim 5 wherein said reflector means is a reflective surface on said inner surface of said lamp housing.

7. A decorative illuminated artificial icicle assembly as recited in claim 6 wherein said reflective surface has a concave configuration.

8. A decorative illuminated artificial icicle assembly as recited in claim 1 wherein said light ray passage open space has a substantially annular configuration.

9. A decorative illuminated artificial icicle assembly as recited in claim 1 wherein said icicle-shaped body member is tubular and has an inner surface.

10. A decorative illuminated artificial icicle assembly as recited in claim 9 wherein said light source is positioned such that light rays therefrom are directed toward said inner surface of said icicle-shaped body member and also directed toward said outer surface of said icicle-shaped body member.

11. A decorative illuminated artificial icicle assembly as recited in claim 9 wherein said bottom end of said icicle-shaped body member has an aperture in communication with said inner surface of said icicle-shaped body member to allow moisture therein to drain outwardly therethrough.

12. A decorative illuminated artificial icicle assembly as recited in claim 1 wherein said icicle-shaped body member is made of plastic material.

13. A decorative illuminated artificial icicle assembly as recited in claim 12 wherein said plastic material is PLEXIGLASS.

14. A decorative illuminated artificial icicle assembly as recited in claim 1 further comprising means for changing the color of said light rays illuminating said icicle-shaped body member.

15. A decorative illuminated artificial icicle assembly as recited in claim 14 wherein said means for changing the color of said light rays is a colored lens positioned between said light source and said top end of said icicle-shaped body member.

16. A decorative illuminated artificial icicle assembly as recited in claim 1 further comprising an electrical cord connected to said light source.

17. A decorative illuminated artificial icicle assembly as recited in claim 16 further comprising a plurality of said decorative illuminated artificial icicle assemblies connected to said electrical cord.

18. A decorative illuminated artificial icicle assembly as recited in claim 1 wherein said means for securing said top end of said icicle-shaped body member to said open bottom end of said lamp housing comprises at least two radially extending fingers formed on said top end of said icicle-shaped body member that are detachably connected to support arms extending inwardly from said inner surface of said lamp housing.

19. A decorative illuminated artificial icicle assembly as recited in claim 1 wherein said means for securing said top end of said icicle-shaped body member to said open bottom end of said lamp housing comprises bayonet-type locking structure.

* * * * *